US005287255A

United States Patent [19]

Strodtman

[11] Patent Number: 5,287,255

[45] Date of Patent: Feb. 15, 1994

[54] COMBINATION FLASHLIGHT-BATON

[76] Inventor: Forrest E. Strodtman, P.O. Box 1237, Channelview, Tex. 77530

[21] Appl. No.: 845,219

[22] Filed: Mar. 3, 1992

[51] Int. Cl.[5] ..... F21L 1/00; A45B 3/04; A45B 3/12; A63B 15/02

[52] U.S. Cl. ..... 362/102; 362/202; 273/84 R

[58] Field of Search ..... 362/102, 109, 190, 191, 362/202, 431, 457; 273/84 R, 84 ES

[56] References Cited

U.S. PATENT DOCUMENTS

| | | | |
|---|---|---|---|
| 4,365,808 | 12/1982 | Perez | 273/84 R |
| 4,744,013 | 5/1988 | Lee et al. | 362/202 |
| 4,752,072 | 6/1988 | Parsons | 273/84 R |
| 4,819,137 | 4/1989 | Hamilton | 273/84 R |
| 4,964,636 | 10/1990 | Ashihara | 273/84 R |
| 5,031,827 | 7/1991 | von Braunhut | 273/84 R |

FOREIGN PATENT DOCUMENTS

| | | | |
|---|---|---|---|
| 0462582 | 12/1991 | European Pat. Off. | 273/84 R |
| 0474206 | 3/1992 | European Pat. Off. | 273/84 R |
| 16565 | of 1902 | United Kingdom | 273/84 R |

OTHER PUBLICATIONS

Dick Tracy, Washington Post, May 31, 1970, Comic Strip.

*Primary Examiner*—Richard R. Cole
*Assistant Examiner*—Y. Quach
*Attorney, Agent, or Firm*—Kenneth A. Roddy

[57] ABSTRACT

A combination flashlight-baton has a head assembly connected at one end of a flashlight barrel which houses a substantially parabolic reflector, a planar lens, a lamp bulb receptacle, and a lamp bulb. A battery source of power is contained within the barrel and a switch on the barrel energizes the lamp bulb. A baton assembly carried in the tail end of the flashlight barrel has telescoping tubular members movable between a retracted position substantially within the barrel and an extended position extending outwardly therefrom. The innermost tubular telescoping member has a small mass at the distal end. With the baton retracted, the combination flashlight-baton can be carried, stored, and used as a conventional flashlight. To extend the baton, the user holds the flashlight by the handle with the tail end pointing away and sharply snap the wrist forward in a slinging action and the telescoping members are extended outwardly due to centrifugal force. The telescoping members are maintained in the extended position by frictional engagement and are released by holding the flashlight-baton vertically above a hard surface and bringing it sharply down in the vertical position to strike the distal end of the baton assembly on the hard surface. An adapter fitting or outer baton member carrying the baton assembly allows a conventional flashlight to incorporate a baton without modification of the existing flashlight components and may be provided as a conversion kit for existing flashlights.

21 Claims, 3 Drawing Sheets

COMBINATION FLASHLIGHT-BATON

BACKGROUND OF THE INVENTION

1. Field of the Invention

This invention relates generally to flashlight and baton apparatus, and more particularly to a combination flashlight and expandable baton.

2. Brief Description of the Prior Art

Law enforcement and security persons typically carry a flashlight and a baton when on security patrol or when called upon to apprehend a suspect. The flashlight utilized by law enforcement and security persons is typically of metallic construction and in some circumstances may be used as a defensive weapon. The baton is a hand held club-like defensive weapon used to defend against attacks or to disarm or subdue an assailant.

A common type of baton, called a night stick or billy is a rigid elongate wooden club having a hand grip portion at one end and a looped strap which fits over the wrist. Another common baton, known as a "side-handle" baton is a rigid elongate rigid club with a handle extending outwardly perpendicular to the longitudinal axis of the club. Because the night stick and side-handle batons are rigid and elongate, they are inconvenient to carry and will often interfere with a person's ability to run a maneuver quickly.

More recently, expandable batons of metallic construction, such as the type manufactured by Armament Systems And Procedures, Inc. (ASP) of Wisconsin, are being used by law inforcement and security persons. The expandable baton, in the retracted position, is compact and easily carried and is easily and quickly deployed to the elongate extended position by a slinging action.

However, with either a rigid or expandable type of baton and a separate flashlight, the carrier is faced with a difficult and dangerous situation when it becomes necessary to utilize the baton. Often, the person will be holding the flashlight in one hand while writing a ticket, opening doors, moving obstacles, etc. If it becomes necessary to quickly utilize a baton, the person must release his grasp on the flashlight or switch hands while reaching for the baton, thus either disarming themself, or typing up both hands and making themself vulnerable during a heated confrontation.

Others have attempted to combine the baton with the flashlight. There are several patents which disclose various flashlight-baton combinations.

Kohn, U.S. Pat. No. 5,016,148 discloses a resilient semi-cylindrical shell which is attached to an elongate flashlight body to absorb shock directed through the flashlight when the flashlight is used as a defensive weapon.

Mains, U.S. Pat. No. 4,479,171 discloses combination side arm baton and flashlight combination comprising an elongate flashlight body having a handle extending outwardly perpendicular to the longitudinal axis of the flashlight. The on-off switch is housed in the side handle and the elongate portion of the flashlight is used as the baton. This device, like the "side-handle" baton is elongate, rigid, and bulky, it is inconvenient to carry and will often interfere with the officer's ability to run or maneuver quickly.

Powell, U.S. Pat. No. 2,260,639 discloses a unitary billy-club or night stick having a flashlight unit built into the club housing.

Osaka, U.S. Pat. No. 4,236,544 discloses a walking stick having a transparent or translucent portion and an interior xenon flash tube which produces periodic flashes of high intensity light.

The patents of Kohm, Mains, Powell, and Osaka are rigid unitary devices of fixed length and do not have the desirable features of an expandable baton.

Fan, U.S. Pat. No. 5,041,951 discloses a multipurpose truncheon which can be used as a bar for fighting or a baton for directing traffic. The device has a tubular housing with a hand grip portion, an L-shaped flashlight extension and a finger guard, a rigid cap at the back end of the gripping portion which contains a gas cartridge, and a tubular telescoping electric discharging stick at the front end with a gas nozzle at the outer end. The electric discharge stick portion has a plurality of electric elements (metal strips) along its length. When the stick is extended, the light flashes and the electric elements discharge high voltage and electric sparks. Gas can also be expelled through the nozzle at the end of the stick which also make a shrill sound.

Hamilton, U.S. Pat. No. 4,819,137 discloses a telescoping baton having a flashlight portion at one end. The baton is spring loaded and the hand grip portion has a swivel ring which receives the finger of the user to prevent accidental loss during manipulation and also serves as a key ring. The outer end of the baton has an end cap with a J-slot. In the collapsed condition, the end cap is received on the hand grip portion and to release the baton, the end cap is rotated by the thumb of the user. This device is small to fit in the palm of the hand, or in a pocket or purse.

The present invention is distinguished over the prior art in general, and these patents in particular by a combination flashlight-baton having a head assembly connected at one end of a flashlight barrel which houses a substantially parabolic reflector, a planar lens, a lamp bulb receptacle, and a lamp bulb. A battery source of power is contained within the barrel and a switch on the barrel energizes the lamp bulb. A baton assembly carried in the tail end of the flashlight barrel has telescoping tubular members movable between a retracted position substantially within the barrel and an extended position extending outwardly therefrom. The innermost tubular telescoping member has a small mass at the distal end. With the baton retracted, the combination flashlight-baton can be carried, stored, and used as a conventional flashlight.

To extend the baton, the user holds the flashlight by the handle with the tail end pointing away and sharply snaps the wrist forward in a slinging action and the telescoping members are extended outwardly due to centrifugal force. The telescoping members are maintained in the extended position by frictional engagement and are released by holding the flashlight-baton vertically above a hard surface and bringing it sharply down in the vertical position to strike the distal end of the baton assembly on the hard surface. An adapter fitting or baton housing carrying the baton assembly allows a conventional flashlight to incorporate a baton without modification of the existing flashlight components and may be provided as a conversion kit for existing flashlights.

SUMMARY OF THE INVENTION

It is therefore an object of the present invention to provide a combination flashlight-baton having an expandable baton which, in the retracted condition, is carried, stored, and used as a conventional flashlight, and, with the baton in the extended condition may be used as a defensive weapon.

It is another object of this invention to provide a combination flashlight-baton wherein the baton is quickly deployed to an extended condition by holding the flashlight by the handle with the tail end pointing away and sharply snapping the wrist forward in a slinging action.

Another object of this invention is to provide a baton conversion kit which will allow a conventional flashlight to be converted to incorporate a defensive baton apparatus.

Another object of this invention is to provide a baton assembly which is quickly and easily installed in the tail end of a conventional flashlight barrel without modification of the existing flashlight components.

A further object of this invention is to provide a method of quickly and easily converting a conventional flashlight into a combination flashlight-baton.

A still further object of this invention is to provide a combination flashlight-baton which is simple in construction, economical to manufacture, and rugged and reliable in use.

Other objects of the invention will become apparent from time to time throughout the specification and claims as hereinafter related.

The above noted objects and other objects of the invention are accomplished by a combination flashlight-baton having a head assembly connected at one end of a flashlight barrel which houses a substantially parabolic reflector, a planar lens, a lamp bulb receptacle, and a lamp bulb. A battery source of power is contained within the barrel and a switch on the barrel energizes the lamp bulb. A baton assembly carried in the tail end of the flashlight barrel has telescoping tubular members movable between a retracted position substantially within the barrel and an extended position extending outwardly therefrom. The innermost tubular telescoping member has a small mass at the distal end. With the baton retracted, the combination flashlight-baton can be carried, stored, and used as a conventional flashlight.

To extend the baton, the user holds the flashlight by the handle with the tail end pointing away and sharply snaps the wrist forward in a slinging action and the telescoping members are extended outwardly due to centrifugal force. The telescoping members are maintained in the extended position by frictional engagement and are released by holding the flashlight-baton vertically above a hard surface and bringing it sharply down in the vertical position to strike the distal end of the baton assembly on the hard surface. An adapter fitting or baton housing carrying the baton assembly allows a conventional flashlight to incorporate a baton without modification of the existing flashlight components and may be provided as a conversion kit for existing flashlights.

DESCRIPTION OF THE PREFERRED EMBODIMENT

Figure 1:
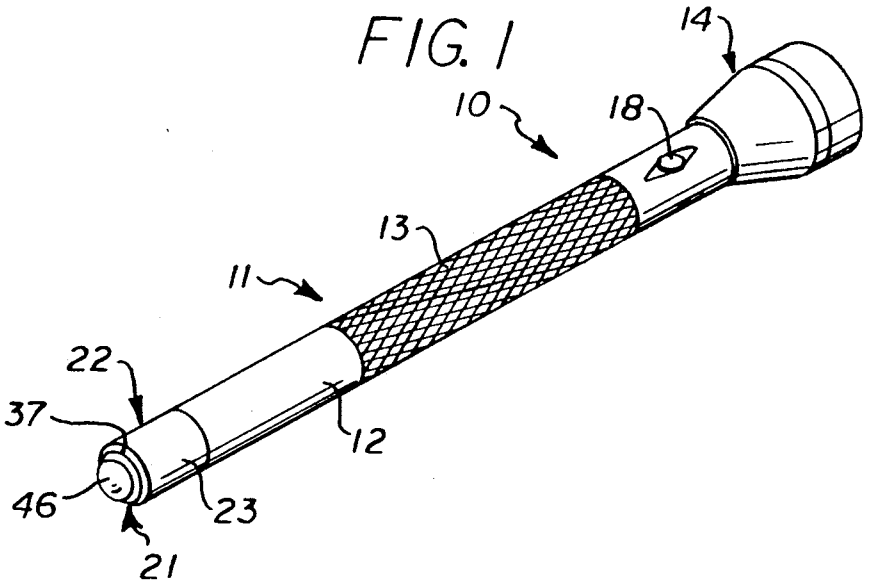
FIG. 1 is an isometric view of a preferred combination flashlight-baton in accordance with the present invention shown in the collapsed condition.
Figure 2:
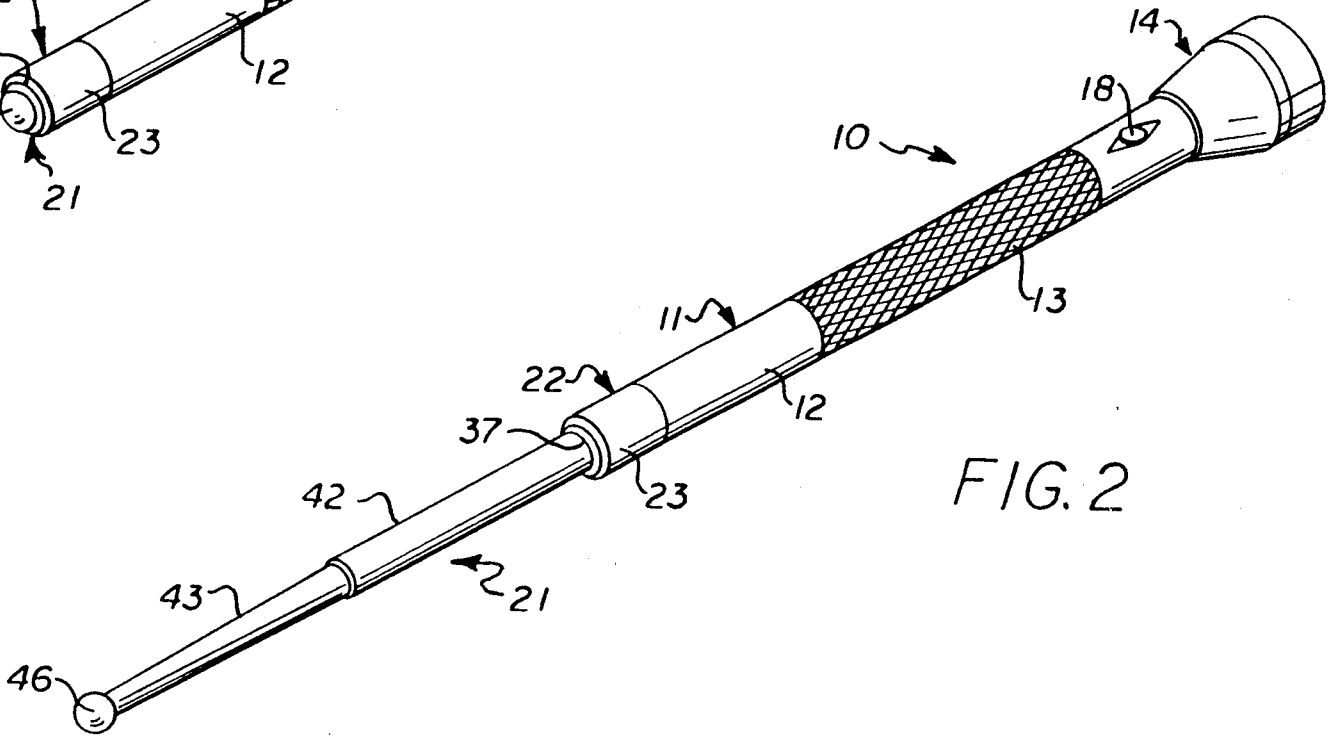
FIG. 2 is an isometric view of the combination flashlight-baton of FIG. 1 shown in the expanded condition.

Referring to the drawings by numerals of reference, there is shown in FIG. 1, a preferred combination flashlight-baton 10 in a retracted condition and in FIG. 2, the combination flashlight-baton 10 is shown in the extended condition.

Figure 3:
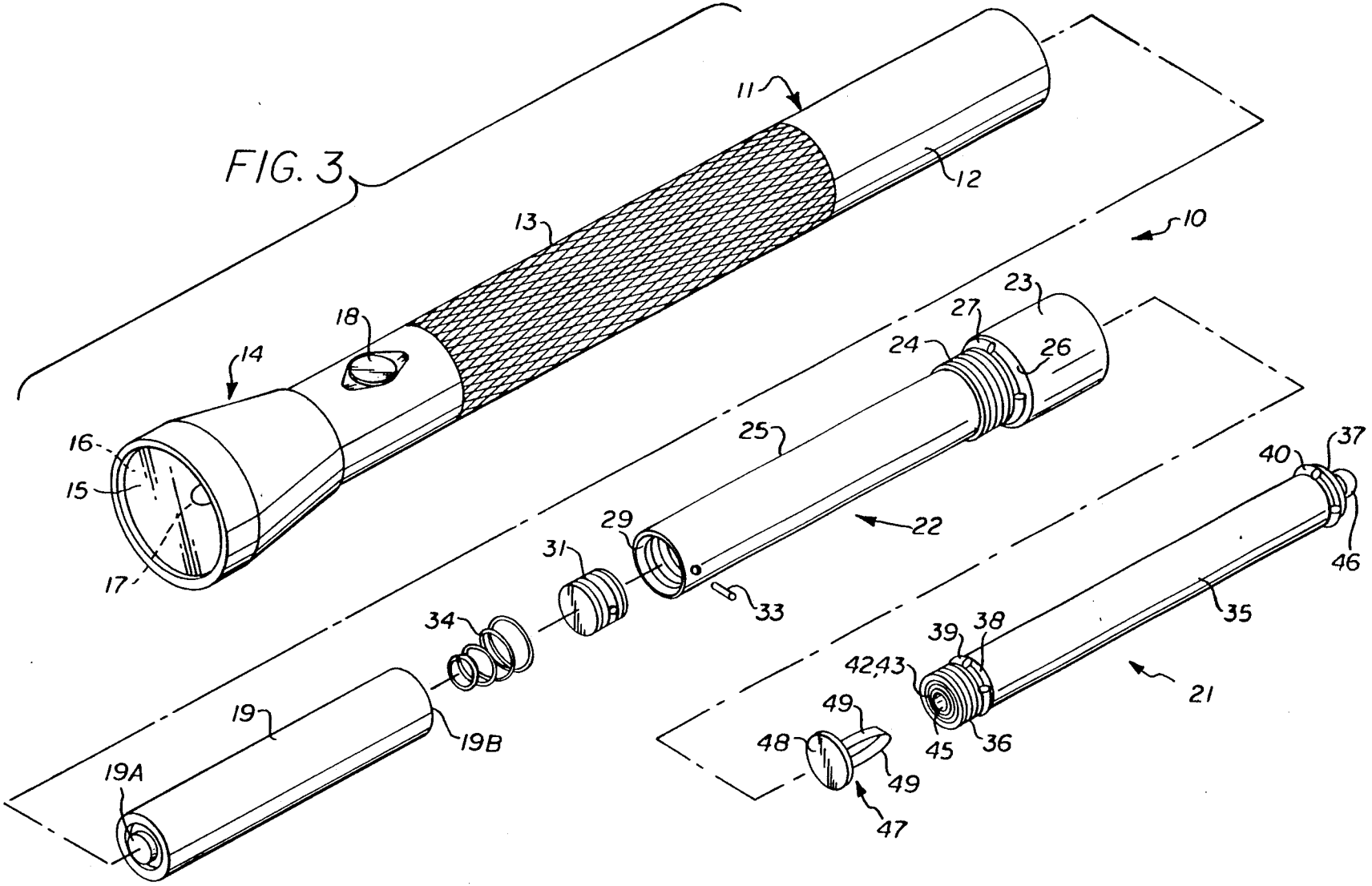
FIG. 3 is an exploded isometric view of the major components of the preferred combination flashlight-baton in an unassembled condition.
Figure 4:
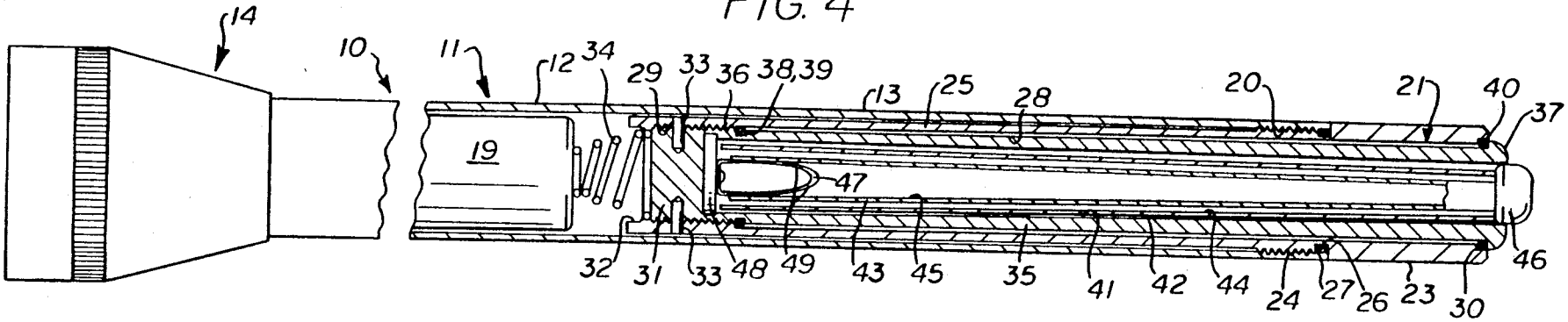
FIG. 4 is a longitudinal cross section of the combination flashlight-baton in the assembled condition with the baton element shown in the collapsed condition.
Figure 5:
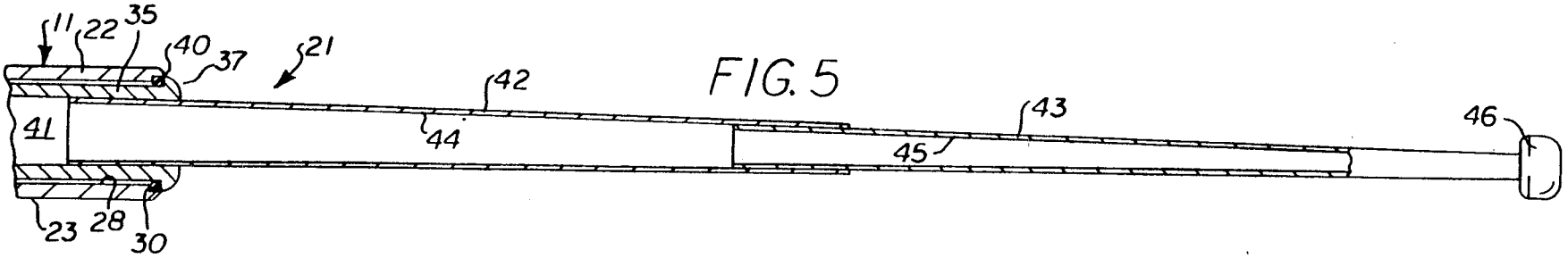
FIG. 5 is a longitudinal cross section of the rear portion of the combination flashlight-baton with the baton element shown in the expanded condition.

Referring additionally to FIGS. 3, 4, and 5, the combination flashlight-baton 10 has a flashlight housing 11 having an elongate tubular barrel 12 of metallic construction with a hand grip portion 13 intermediate its ends and a head assembly 14 at one end of the barrel. The flashlight head assembly 14 includes the usual planar lens 15, a substantially parabolic reflector 16, a lamp bulb 17 carried in a lamp bulb receptacle disposed at the rear of the reflector. A switch 18 is mounted on the barrel 12 adjacent the head assembly 14 and is operative to open and close electrical communication between the lamp bulb 17 and a battery pack 19 contained within the barrel for selectively energizing the lamp bulb. The head assembly 14 and switch 18 are of conventional construction known in the art and therefore not shown in detail. The head assembly 14 is preferably of the type which will allow the light beam to be selectively varied in area and intensity by rotating the head relative to the barrel. The tail or rear end of the barrel 12 has internal threads 20 (FIG. 4).

An expandable baton assembly 21 is telescopically carried in a tubular adapter 22 which is received in the tail end of the flashlight barrel 12. The tubular adapter 22 is formed of electrically conductive material, such as aluminum. As best seen in FIGS. 3 and 4, the exterior of the tubular adapter 22 has a relatively short rear portion 23 which is approximately the same diameter as the outside diameter of the flashlight barrel 12 and an externally threaded portion 24 which extends a distance toward the front end and terminates in a reduced diameter portion 25 which is slightly smaller than the inside diameter of the flashlight barrel. An O-ring groove 26 is formed between the forward end of the rear portion 23 and the external threads 24 and receives an O-ring 27. The external threads 24 are designed to engage the interior threads 20 at the rear end of the flashlight barrel 12 with the O-ring 27 received in a counterbore at the rear end of the barrel.

The interior of the tubular adapter 22 has a central bore 28 which extends from the rear end and terminates in an internally threaded portion 29 at the forward end. A counterbore 30 is formed at the rear end of the central bore 28. A threaded plug 31 of electrically conductive material is threadedly received in the internally threaded forward end 29 of the tubular adapter 22 and positioned to enclose the forward end and define a shallow recess 32 at the front end of the tubular adapter. The plug 31 is secured in position by one or more pins or set screws 33 installed through apertures in the side wall of the tubular adapter 22 and into the plug. The shallow recess 32 at the forward end of the tubular adapter 22 serves as a receptacle for one end of a compression spring 34.

The expandable baton assembly 21 has an outer tubular housing 35 with external threads 36 at the front end, and an enlarged diameter radial flange 37 at the rearward end. An O-ring groove 38 is formed on the exterior of the outer tubular housing 35 rearward of the threads 36 and receives an O-ring 39. Another O-ring 40 is received on the exterior of the outer tubular housing 35 adjacent the inward facing shoulder of the radial flange 37. The interior of the outer housing 35 has a tapered bore 41 which tapers from a larger diameter at the front end to a smaller diameter at the rear end. A first telescoping member 42 and a second telescoping member 43 each having a tapered bore 44 and 45, respectively, which taper from a larger diameter at the front end to a smaller diameter at the rear end are slidably received in the outer housing 35. The second or innermost telescoping member 43 has a rounded bulbous end 46 which in the collapsed position is received partially within the opening at the rear end of the outer housing radial flange 37. The rounded bulbous end 46, which may be solid metal, provides a small mass or weight at the distal end of the tubular member 43 and facilitates collapsing the baton as explained hereinafter.

As seen in FIG. 5, the tapered bores of the outer housing 35 and telescoping members 42 and 43 are such that the larger ends of the members will seat in frictional engagement against the smaller ends of the adjacent member when in the expanded position and prevent the inner members from sliding out of the adjacent outer member in the expanded position.

The telescoping members 42 and 43 are retained in the retracted or collapsed position (FIG. 4), by a friction spring member 47. The friction spring member 47 has a flat disc-like base 48 and a pair of opposed outwardly bowed leaf spring members 49 which extend outwardly therefrom in opposed relation and converge at their outer ends. In the assembled condition, the base 48 of the friction spring member 47 is captured between the plug 31 and the front end of the outer housing 35 when the outer housing is threadedly engaged in the forward end of the adapter 22. When the telescoping members 42 and 43 are collapsed in the nested position, the outwardly bowed portions of the leaf springs 49 are frictionally received inside the bore 45 at the larger end of the innermost telescoping member 43, and are compressed as they are received therein such that the innermost telescoping member 43 is frictionally engaged on the leaf springs 49. The rounded bulbous end 46 of the innermost telescoping member 43 overlaps the rear end of the outer telescoping member 42 and prevents the outer telescoping member from sliding outwardly.

Having described the major components of the combination flashlight-baton 10, the components are assembled as follows, assuming that the head assembly 14 is already installed on the front end of the flashlight barrel 12. With the telescoping members 42 and 43 installed in the outer housing 35 in the nested position, the base 48 of the friction spring member 47 is pressed against the front end of the outer housing 35 to frictionally engage the leaf springs 49 into the larger end of the inner telescoping member 43. The O-rings 39 and 40 are installed on the forward and rearward ends, respectively, of the outer housing 35.

The baton assembly 21 is then slid into the rear end of the tubular adapter 22 and rotated to engage the threads 36 at the forward end of the outer housing 35 with the interior threads 2 at the forward end of the tubular adapter and capture the base 48 of the friction spring member 47 between the plug 31 and the front end of the outer housing 35. When the baton assembly 21 is properly installed in the tubular adapter 22, the O-ring 39 is engaged between exterior of the outer housing 35 and the interior bore 28 of the tubular adapter 22 and the O-ring 40 is received in the counterbore 30 and engaged between the radial flange 37 at the rear end of the outer member 35 and the rear end of the tubular adapter 22. Thus, the tubular adapter 22 and baton assembly 21 are assembled into a single unit. The O-ring 27 is installed on the exterior of the tubular adapter 2 and the larger end of the compression spring 34 is pressed into the recess 32 at the front of the adapter.

The battery pack 19 (described in detail hereinafter) is slid into the rear end of the flashlight barrel 12, and the tubular adapter 22 with the compression spring 34 at the forward end is slid into the rear end of the flashlight barrel and rotated to engage the exterior threads 24 at the rearward end of the adapter with the interior threads 20 at the rear end of the flashlight barrel and seat the O-ring 27 into the counterbore at the rear end of the flashlight barrel.

When the tubular adapter 22 and baton assembly 21 is properly installed in the rear end of the flashlight barrel 12, the battery pack 19 (described hereinafter) has its center electrode end 19A engaged on the contact of the lamp bulb receptacle which is in electrical communication with one pin of the lamp bulb 17. The compression spring 34 is disposed with one end engaged on the rear end (outer electrode) 19B of the battery pack 19 and its other end engaged on the tubular adapter 22. The switch 18 has one terminal connected to the lamp bulb receptacle and another terminal connected to the metal flashlight barrel 12. Thus, when the switch 18 is turned on, an electrical circuit is completed through the switch from one pin of the lamp bulb, through the lamp receptacle contact, and to the center electrode 19A of the battery pack 19, and from other electrode 19B of the battery pack 19 through the compression spring 34, the tubular adapter 22, and via the adapter threads 24 through the flashlight barrel and back to the switch 18.

The reduced diameter portion 25 of the tubular adapter 22 which extends into the flashlight barrel 12 takes up an amount of space normally occupied by regular size 1.5 volt dry-cell batteries. For example, in a barrel designed to contain four to six C-cells, the adapter would occupy the length of three regular size C-cells. Several options are available to compensate for the reduced battery space. One option is to simply use a fewer number of regular size batteries which results in slightly diminished illumination. The illumination can be increased by using a halogen lamp bulb, but is not required. Another option is to use a commercially available battery pack 19 which is the same length as a number of regular size batteries but has a higher voltage rating than the stack of regular size batteries. A rechargeable battery pack may also be used.

In the preferred embodiment, a commercially available rechargeable battery pack 19 is used to compensate for the reduced battery space. For example, a 6 volt "½ C-cell" battery pack unit consisting of a number of short cells would occupy the same amount of space as three regular size 1.5 volt C-cells but would produce 6 volts. For maximum illumination, a rechargeable battery pack in combination with a high intensity lamp bulb is recommended.

Figure 6:
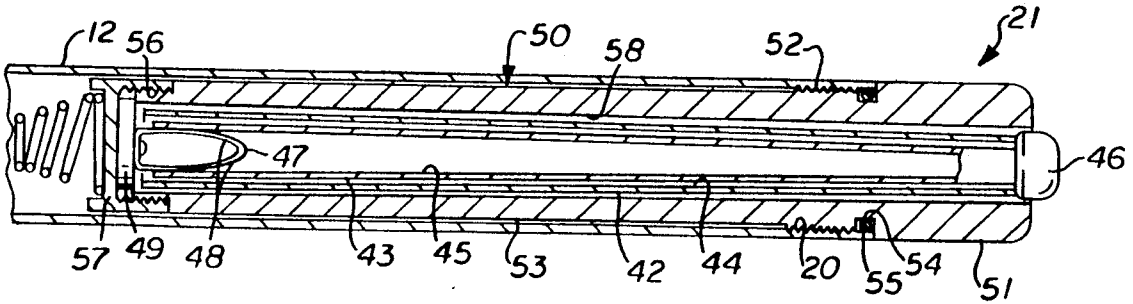
FIG. 6 is a longitudinal cross section of the rear portion of the combination flashlight-baton showing a modification of the baton outer housing.

The adapter 22 adapts a baton housing of conventional size to fit flashlight barrels of conventional size. However, as shown in FIG. 6, the baton assembly 21 may be provided with a modified outer housing 50 which fits into the flashlight barrel rather than using an adapter. In this modification, the exterior of the baton outer housing 50 has a relatively short rear portion 51 which is approximately the same diameter as the outside diameter of the flashlight barrel 12 and an externally threaded portion 52 which extends a distance toward the front end and terminates in a reduced diameter portion 53 which is slightly smaller than the inside diameter of the flashlight barrel. An O-ring groove 54 is formed between the forward end of the rear portion 51 and the external threads 52 and receives an O-ring 55. The external threads 52 are designed to engage the interior threads 20 at the rear end of the flashlight barrel 12 with the O-ring 55 received in a counterbore at the rear end of the barrel. The front end of the reduced diameter portion 53 has external threads 56 onto which an end cap 57 is threadedly received.

The interior of the outer housing 50 has a tapered bore 58 which tapers from a larger diameter at the front end to a smaller diameter at the rear end. As previously described, a first telescoping member 42 and a second telescoping member 43 each having a tapered bore 44 and 45, respectively, which taper from a larger diameter at the front end to a smaller diameter at the rear end are slidably received in the outer housing 50. The second or innermost telescoping member 43 has a rounded bulbous end 46 which in the collapsed position is received partially within the opening at the rear end of the outer housing. The rounded bulbous end 46, which may be solid metal, provides a small mass or weight at the distal end of the tubular member 43 and facilitates collapsing the baton as explained hereinafter.

With the modified outer housing 50, the base 48 of the previously described friction spring member 47 is captured against the front end of the outer housing 50 when the end cap 57 is installed on the end. The outer end of the end cap 57 engages one end of the compression spring 34 when installed in the barrel. The baton components are engaged and disengaged on the leaf spring and operate in the same manner as described previously, and will not be repeated to avoid repetition.

One of the major utilitarian features of the present invention is that the novel tubular adapter 22 or baton outer housing 50 allows a conventional flashlight to be converted to incorporate a baton without modification of the existing flashlight components. In such a conversion, the end cap of the existing flashlight is not used, and the tubular adapter 22 or the baton outer housing 50 is installed in place of the end cap. To this end, the adapter 22 and baton assembly 21, or the baton assembly having a modified outer housing 50 may be sold as a separate unit as a conversion kit, along with a battery pack 19, which would allow the kit to be purchased and installed in existing flashlights. The adapter or modified baton housing will only slightly extend the length of the existing flashlight.

From the foregoing description, it can be seen that the combination flashlight-baton is only slightly longer than a conventional flashlight and, with the baton in the retracted position, can be carried, stored, and used as the conventional flashlight. When it becomes necessary to deploy the baton, the user merely holds the flashlight by the handle with the tail pointing away and sharply snaps the wrist forward in a slinging action.

The centrifugal force acting on the bulbous end 46 of the innermost telescoping member 43 due to the slinging action overcomes the spring force of the leaf springs 49 on the central bore 45 and the innermost telescoping member slides axially outward. As the innermost telescoping member 43 slides outwardly, the exterior of its larger end engages the interior diameter near the smaller end of the surrounding outer telescoping member 42 and carries it outwardly with the inner member 43. As the inner and outer telescoping members travel outward from the outer housing 35, the larger end of the outer telescoping member 42 engages the tapered bore 41 of the outer housing and the larger end of the inner telescoping member 43 engages the tapered bore 44 of the outer telescoping member 42 in a friction fit. The friction fit of the telescoping members will retain them in the extended position.

In the preferred embodiment, the extended baton will extend approximately 12"–14" outwardly from the tail end of the flashlight. The combination flashlight-baton with the baton extended also provides greater impact force than a regular baton alone due to the weight and length of the flashlight. When the baton is quickly extended, it produces a loud clack or snapping sound which has been found to produce a surprising and stunning psychological effect on a potential adversary, which often results in passive submission, solely by extending the baton.

The extended flashlight-baton is retracted by holding it vertically above a hard surface and bringing it sharply downward in the vertical position to firmly strike the rounded bulbous end 46 on the hard surface. The sharp vertical blow transmitted axially through the engaged telescoping members is sufficient to overcome the frictional gripping force between the tapered surfaces and disengage the members. As the flashlight barrel travels downwardly relative to the telescoping members, the leaf springs 49 are once again forced into frictional engagement within the bore 45 at the larger end of the inner telescoping member 43.

While this invention has been described fully and completely with special emphasis upon a preferred embodiment, it should be understood that within the scope of the appended claims the invention may be practiced otherwise than as specifically described herein.

I claim:

1. A combination flashlight-baton for use as a flashlight and a self-defense baton comprising;

a flashlight barrel for containing a battery source of power;

a flashlight head assembly connected at one end of said flashlight barrel including a substantially parabolic reflector, a planar lens, a lamp bulb receptacle, and a lamp bulb carried therein;

a switch positioned adjacent one end of said flashlight barrel and operatively connected with said battery source of power and said lamp bulb to energize said lamp bulb;

a tubular adapter member removably secured substantially in said flashlight barrel;

at least one tubular member having an inward end and a distal end and slidably disposed within said tubular adapter member and movable between a retracted position substantially within said tubular adapter member and an extended position extending outwardly therefrom;

retaining spring means within said tubular adapter member for releasably engaging said at least one tubular member inward end and retaining said at least one tubular member in the retracted position; and said at least one tubular member being disengaged from said retaining spring means and extended outwardly by centrifugal force acting thereon upon a slinging motion of said flashlight barrel for use as a self-defense baton.

2. The combination flashlight-baton according to claim 1 wherein said at least one tubular member is tapered from a larger inward end to a smaller distal end and has a central bore, and said retaining spring means comprises a friction spring member having a base portion contained within said tubular adapter member and a pair of opposed outwardly bowed leaf springs extending outwardly therefrom coaxial with said at least one tubular member and converging at their distal ends, and said outwardly bowed leaf springs are compressed and received in frictional engagement within said central bore at said larger inward end of said at least one tubular member in the retracted position and are disengaged therefrom upon sufficient outward force imparted by the centrifugal force on said at least one tubular member.

3. The combination flashlight-baton according to claim 1 comprising;

an inner end and outer telescoping tubular member slidably received one within the other and movable in telescoping relation between a retracted position substantially within said tubular adapter member and an extended position extending outwardly therefrom, said inner telescoping tubular member carrying said outer telescoping tubular member inwardly and outwardly therewith, and means on said telescoping tubular members for maintaining said telescoping tubular members in the extended position.

4. The combination flashlight-baton according to claim 3 wherein said telescoping tubular members are each tapered from a larger inward end to a smaller distal end and have a central bore tapered from one end to the other, and said means for maintaining said telescoping tubular members in the extended position comprises sizing said larger inward end of said inner telescoping tubular member to engage in a friction fit with respect to said smaller distal end of the surrounding said outer telescoping tubular member.

5. The combination flashlight-baton according to claim 4 wherein said telescoping tubular members are retracted by holding said combination flashlight-baton in the extended position vertically above a hard surface and quickly bringing it sharply downward in a vertical position to strike said distal end of said inner telescoping tubular member on the hard surface, such that the vertical force transmitted axially through the engaged said telescoping tubular members is sufficient to overcome the frictional engagement between said telescoping tubular members and disengage them, and as said flashlight barrel travels downwardly relative to said telescoping tubular members, said retaining spring means is forced into engagement with said inner telescoping tubular member.

6. The combination flashlight-baton according to claim 1 wherein said flashlight barrel is a tubular member having threads at one end, said tubular adapter member has a threaded portion corresponding to said flashlight barrel threads and is threadedly secured on said flashlight barrel.

7. An extendable self-defense baton assembly adapted to be removably attached to a barrel portion of a flashlight, the self-defense baton assembly comprising:

an outer housing configured to be received substantially within said barrel portion of a flashlight and removably engaged thereon; and at least one telescoping tubular member having an inward end and a distal end slidably disposed within said outer housing and movable between a retracted position substantially within said outer housing and an extended position extending outwardly therefrom.

8. The extendible self-defense baton assembly according to claim 7 including retaining means connected with said outer housing for releasably retaining said at least one telescoping tubular member in the retracted position; and said at least one telescoping tubular member being extended outwardly by centrifugal force acting thereon upon a slinging motion of said barrel portion of the flashlight.

9. The extendible self-defense baton assembly according to claim 8 wherein said retaining means comprises friction means disposed at one end of said outer housing and having an outwardly extending portion coaxial with said at least one telescoping tubular member to receive and frictionally engage said inward end of said at least one telescoping tubular member in the retracted position, and said at least one telescoping tubular member being disengaged therefrom by centrifugal force acting thereon upon a slinging motion of said barrel portion of the flashlight.

10. The extendible self-defense baton assembly according to claim 9 wherein said at least one telescoping tubular member is tapered from a larger inward end to a smaller distal end and has a central bore, and said friction means comprises a friction spring member having a base portion engaged at said one end of said outer housing and a pair of opposed outwardly bowed leaf springs extending outwardly therefrom coaxial with said at least one telescoping tubular member and converging at their distal ends, and said outwardly bowed leaf springs are compressed and received in frictional engagement within said central bore at said larger inward end of said at least one tubular member in the retracted position and are disengaged therefrom upon sufficient outward force imparted by the centrifugal force on said at least one tubular member.

11. The extendible self-defense baton assembly according to claim 7 comprising;

an inner and an outer telescoping tubular member slidably received one within the other and movable in telescoping relation between a retracted position substantially within said outer housing and an extended position extending outwardly therefrom, said inner telescoping tubular member carrying said outer telescoping tubular member inwardly and outwardly therewith, and means on said telescoping tubular members for maintaining said telescoping tubular members in the extended position, and retaining spring means disposes at one end of said outer housing to receive and frictionally engage said inner telescoping tubular member in the retracted position.

12. The extendible self-defense baton assembly according to claim 11 wherein said telescoping tubular members are each tapered from a larger inward end to a smaller distal end and have a central bore tapered from one end to the other.

13. The extendible self-defense baton assembly according to claim 12 wherein said means for maintaining said telescoping tubular members in the extended position comprises sizing said larger inward end of each said telescoping tubular member to engage in a friction fit with respect to said smaller distal end of a surrounding telescoping tubular member.

14. The extendible self-defense baton assembly according to claim 11 wherein said extendable baton assembly is retracted by holding said barrel portion with said extendible baton assembly engaged thereon in the extended position vertically above a hard surface and quickly bringing it sharply downward in a vertical position to strike a distal end of said inner telescoping tubular member on the hard surface, such that the vertical force transmitted axially through the engaged said telescoping tubular members is sufficient to overcome the frictional engagement between said telescoping tubular members and disengage them, and as said barrel portion travels downwardly relative to said telescoping tubular members, said retaining spring means is forced into engagement with said inner telescoping tubular member.

15. The extendible self-defense baton assembly according to claim 7 wherein said barrel portion is a tubular member having threads at one end, said outer housing member is a tubular member having a threaded portion corresponding to said barrel portion threads and is threadedly secured on said barrel portion.

16. An adapter fitting for a barrel portion of a flashlight for connecting a self-defense baton assembly to the barrel portion of the flashlight, the adapter fitting comprising:

an adapter fitting having an exterior configured to be received substantially within said barrel portion of the flashlight and removably engaged on said barrel portion of the flashlight and an interior configured to receive a self-defense baton assembly.

17. The adapter fitting according to claim 16 wherein the self-defense baton assembly has an outer housing with threads at one end, and said adapter fitting interior has a threaded portion at one end corresponding to the baton assembly threads for threadedly engaging the self-defense baton outer housing.

18. The adapter fitting according to claim 17 wherein said barrel portion of the flashlight is a tubular member having threads at one end, and said adapter fitting is a tubular member having a threaded portion corresponding to said barrel portion threads and is threadedly secured thereon.

19. The adapter fitting according to claim 18 wherein the baton assembly has at least one telescoping member slidably disposed therein and movable between a retracted position substantially within the baton outer housing and an extended position extending outwardly therefrom, and said adapter fitting is of sufficient length to substantially enclose the baton assembly in the retracted position.

20. A method of converting a flashlight into a combination flashlight-baton for use as a flashlight and a self-defense baton, the flashlight of the type having a barrel with an open end for receiving a battery source of power contained within the barrel by a spring and a removable end cap, the method comprising the steps of;

providing an adapter fitting having an exterior configured to be received substantially within the open end of the flashlight barrel and removably engaged on the flashlight barrel at the open end and having an extendible self-defense baton member connected therewith which has least one telescoping tubular member slidably disposed therein and movable between a retracted position substantially within said adapter fitting and an extended position extending outwardly therefrom, installing said adapter fitting substantially within the flashlight barrel, and securing said adapter fitting on the open end of the flashlight barrel in place of the existing removable end cap.

21. The method according to claim 20 wherein said flashlight barrel is a tubular member having threads at the open end, said adapter fitting is a tubular member having a threaded portion corresponding to the threads at the open end of the flashlight barrel, and said step of securing said adapter fitting comprises screwing said adapter fitting on the threads at the open end of the flashlight barrel.

* * * * *